US007504915B2

(12) United States Patent
Takayama et al.

(10) Patent No.: US 7,504,915 B2
(45) Date of Patent: Mar. 17, 2009

(54) ELECTROMAGNETIC RELAY

(75) Inventors: Yohei Takayama, Ritto (JP); Hiroki Arai, Kusatsu (JP); Yasuhiro Takebayashi, Otsu (JP)

(73) Assignee: Omron Corporation, Kyoto-Shi (JP)

( * ) Notice: Subject to any disclaimer, the term of this patent is extended or adjusted under 35 U.S.C. 154(b) by 160 days.

(21) Appl. No.: 11/444,525

(22) Filed: Jun. 1, 2006

(65) Prior Publication Data

US 2006/0279384 A1 Dec. 14, 2006

(30) Foreign Application Priority Data

Jun. 7, 2005 (JP) ..... P2005-166704

(51) Int. Cl.
*H01H 51/22* (2006.01)
*H01H 67/02* (2006.01)

(52) U.S. Cl. ..... 335/78; 335/80; 335/128; 335/129; 335/131

(58) Field of Classification Search ..... 335/78
See application file for complete search history.

(56) References Cited

U.S. PATENT DOCUMENTS 4,307,362 A * 12/1981 Kobler et al. ..... 335/202
4,325,043 A * 4/1982 Kimpel ..... 335/229
4,539,540 A * 9/1985 Kimpel et al. ..... 335/125
5,568,108 A * 10/1996 Kirsch ..... 335/130
6,025,766 A * 2/2000 Passow ..... 335/78
6,034,582 A * 3/2000 Fausch ..... 335/78
6,340,923 B1 * 1/2002 Yamanaka et al. ..... 335/4
6,538,540 B2 * 3/2003 Oberndorfer et al. ..... 335/78
6,661,320 B1 * 12/2003 Fausch ..... 335/129
6,734,770 B2 * 5/2004 Aigner et al. ..... 335/78
6,906,604 B1 * 6/2005 Mader et al. ..... 335/129

* cited by examiner

*Primary Examiner*—Elvin G Enad
*Assistant Examiner*—Alexander Talpalatskiy
(74) *Attorney, Agent, or Firm*—Foley & Lardner LLP

(57) ABSTRACT

An electromagnetic block and a movable block are attached onto a base in an inclination attitude. Contact mechanisms press-fitted from above the base are laterally arranged in the inclination attitude, and the contact mechanisms are arranged in parallel in upper and lower stages. Idle end portions of movable contact pieces in the contact mechanisms are latched in a card which is linearly moved in a lateral direction. Terminals are projected downward from a bottom surface of the base, one of the terminals is connected to the fixed contact pieces of the contact mechanism, and the other terminal is connected to the movable contact pieces of the contact mechanism. The upper contact mechanism and the lower contact mechanism are alternately arranged in the lateral direction.

9 Claims, 8 Drawing Sheets

ELECTROMAGNETIC RELAY

This application claims priority from Japanese patent application P2005-166704, filed on Jun. 7, 2005. The entire content of the aforementioned application is incorporated herein by reference.

BACKGROUND OF THE INVENTION

1. Field of the Invention

The present invention relates to a multipolar electromagnetic relay including plural contact mechanisms.

2. Description of the Related Art

For example, in Japanese Patent Application Laid-Open No. 2000-285782 discloses a multipolar electromagnetic relay, in which an electromagnetic block and a movable block are assembled in a longitudinal attitude on a base formed by resin molding, plural contact mechanisms are laterally provided in parallel in two rows while sandwiching a partition, and terminals extended from the respective contact mechanisms are projected from a bottom surface of the base.

In the electromagnetic relay disclosed in Japanese Patent Application Laid-Open No. 2000-285782, although a mounting area in a board can be decreased, sometimes it is difficult to attach the electromagnetic relay to the board in a low-profile housing because the electromagnetic relay is relatively higher. Therefore, in the main board, it is necessary that the electromagnetic relay be assembled in a side-toppling attitude through an auxiliary board connected in an uprising attitude to the main board.

In the electromagnetic relay disclosed in Japanese Patent Application Laid-Open No. 2000-285782, because the plural contact mechanisms are arranged in parallel in two rows while sandwiching the vertically provided partition, in a process of press-fitting a fixed contact piece or a movable contact piece of the contact mechanism into the base, it is necessary that a first row be assembled on one side of the partition and then a second row be assembled on the other side of the partition by reversing the base. This results in one of causes of obstructing improvement of assembling workability.

In view of the foregoing, an object of the present invention is to provide an electromagnetic relay which can be flattened in shape to perform a low profile mounting, downsized for the number of electrodes, and excellent for assembling the internal components.

SUMMARY OF THE INVENTION

In order to achieve the object, the present invention is configured as follows.

An electromagnetic relay of the present invention in which an electromagnetic block having an iron core around which a coil being wound; a movable block having an iron piece which is attracted to and separated from a magnetic pole portion of the electromagnetic block, the movable block is normally and reversely rotated by magnetic excitation and demagnetization of the electromagnetic block; a moving body engaging the movable block to be reciprocally moved in a linear direction according to the normal and reverse rotations; and plural contact mechanisms in which switching is operated by the movement of the moving body are assembled to a base, wherein the electromagnetic block and the movable block are arranged such that a rotating shaft of the movable block is vertically located with respect to a bottom surface of the base, a fixed contact piece and a movable contact piece in the plural contact mechanisms are arranged such that longitudinal directions of the fixed contact piece and the movable contact piece are parallel to the bottom surface of the base, the plural contact mechanisms are arranged in parallel with the moving direction of the moving body while alternately arranged in upper and lower stages along the moving direction of the moving body, a terminal connected to the fixed contact piece and a terminal connected to the movable contact piece are projected downward from the bottom surface of the base, and an idle end portion of the movable contact piece is latched in the moving body.

According to the invention, the electromagnetic block, the movable block, the upper and lower contact mechanism groups, and the moving body are assembled in an inclination attitude with respect to the base. Therefore, the low-profile electromagnetic relay can be realized, and the electromagnetic relay can be mounted on a board without being bulky. The contact mechanisms are arranged in parallel in the upper and lower stages, so that the compact electromagnetic relay can be formed in the moving direction when compared with the case where all the same number of contact mechanisms is arranged in parallel in the one stage. Because each component can be assembled from above the base, it is not necessary that the attitude of the base be changed during the assemble process.

Further, the plural contact mechanisms are alternately arranged in the upper and lower stage along the moving direction of the moving body, namely, the upper contact mechanism and the lower contact mechanism are alternately arranged in the moving direction. Therefore, the insulating properties can be improved between the adjacent upper and lower contact mechanisms while the downsizing is achieved in the moving direction.

In one aspect of the invention, base ends of the fixed contact piece and movable contact piece constituting the contact mechanism are coupled to and supported by a support plate to which the terminal is continuously provided, and an attachment groove into which the support plate is press-fitted is formed in the base.

In the aspect, the support plate to which each contact is coupled can be assembled to the attachment groove of the base by press-fitting the support plate from above.

In one aspect mode of the invention, a partition located between the contact mechanisms is vertically provided in the base, the contact mechanisms being arranged in parallel to the moving direction.

According to the aspect, the insulating properties can be enhanced between the adjacent contact mechanisms arranged in parallel along the moving direction of the moving body.

In one aspect of the invention, the attachment groove is formed in a wall portion vertically provided in the base, the support plate of the contact mechanism arranged in the upper stage being press-fitted into the attachment groove, and the wall portion is continuously provided to the partition.

According to the aspect, the wall portion supporting the contact mechanism and the insulating partition strengthen each other, so that the insulating properties and mechanical durability are effectively enhanced.

In one aspect of the invention, the partition located between the contact mechanisms is provided inside an enclosure fitted over the base, the contact mechanism being arranged in parallel to the moving direction.

According to the aspect, the insulation between the adjacent contact mechanisms is achieved by combining the partition of the base and the partition of the enclosure, so that the insulating properties can further be improved. The partition of the enclosure exerts a function of a reinforcing rib to enhance rigidity of the enclosure in itself.

In one aspect of the invention, the support plate is formed in a shape in which a part of a support plate material is cut, and the support plate material being punched in the same requirement.

In the aspect, the many contact mechanisms can be formed by one kind of the fixed contact piece, one kind of the movable contact piece, and one kind of the support plate material. Therefore, the number of kinds of component punching dies can be decreased to achieve cost reduction.

In one aspect of the invention, a bearing hole is made in a bottom portion of the base while vertically penetrating the bottom portion, the rotating shaft of the movable block being fitted in the bearing hole and supported by the bearing hole, and a boss portion is projected from the bottom surface of the base, the boss portion sealing an opening end of the bearing hole.

According to the aspect, the bearing hole is made so as to penetrate the base. Therefore, when compared with the case where the bearing hole is made in the bore hole which is not opened to the bottom surface of the base, there is no limitation to the method or procedure of inserting the rotating shaft. The intrusion of dust and moisture into the electromagnetic relay can be securely prevented by sealing the bearing hole after the assembly, so that reliability can be improved in the contact switching operation.

Thus, the present invention can provide the electromagnetic relay which can be flattened in shape to perform a low profile mounting, downsized for the number of electrodes, and excellent for assembling the internal components.

DETAILED DESCRIPTION OF THE PREFERRED EMBODIMENTS

Preferred embodiments of the invention will be described below with reference to the accompanying drawings.

Figure 1:
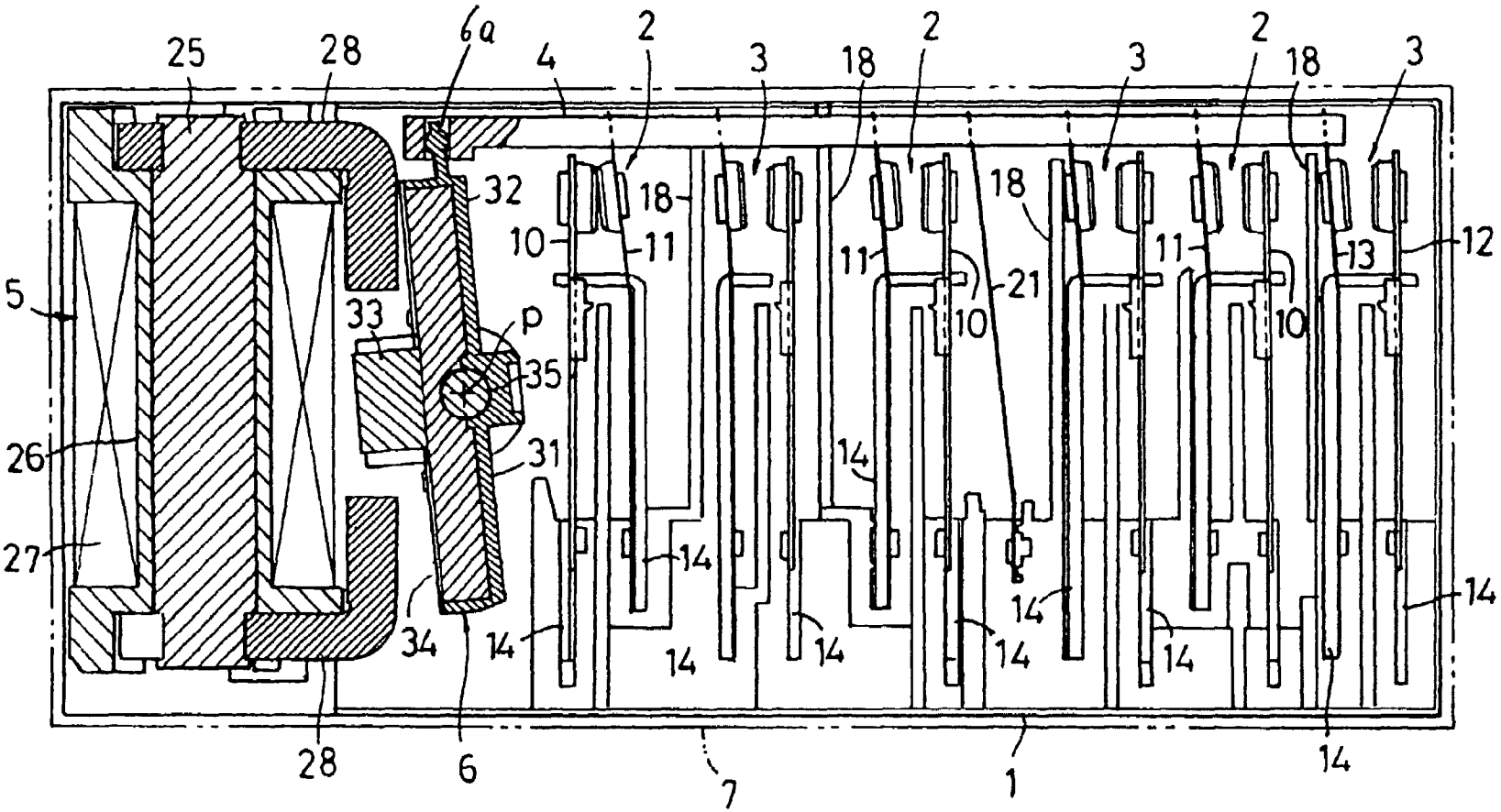
FIG. 1 shows a plan view of the whole of an electromagnetic relay with an enclosure detached.
Figure 2:
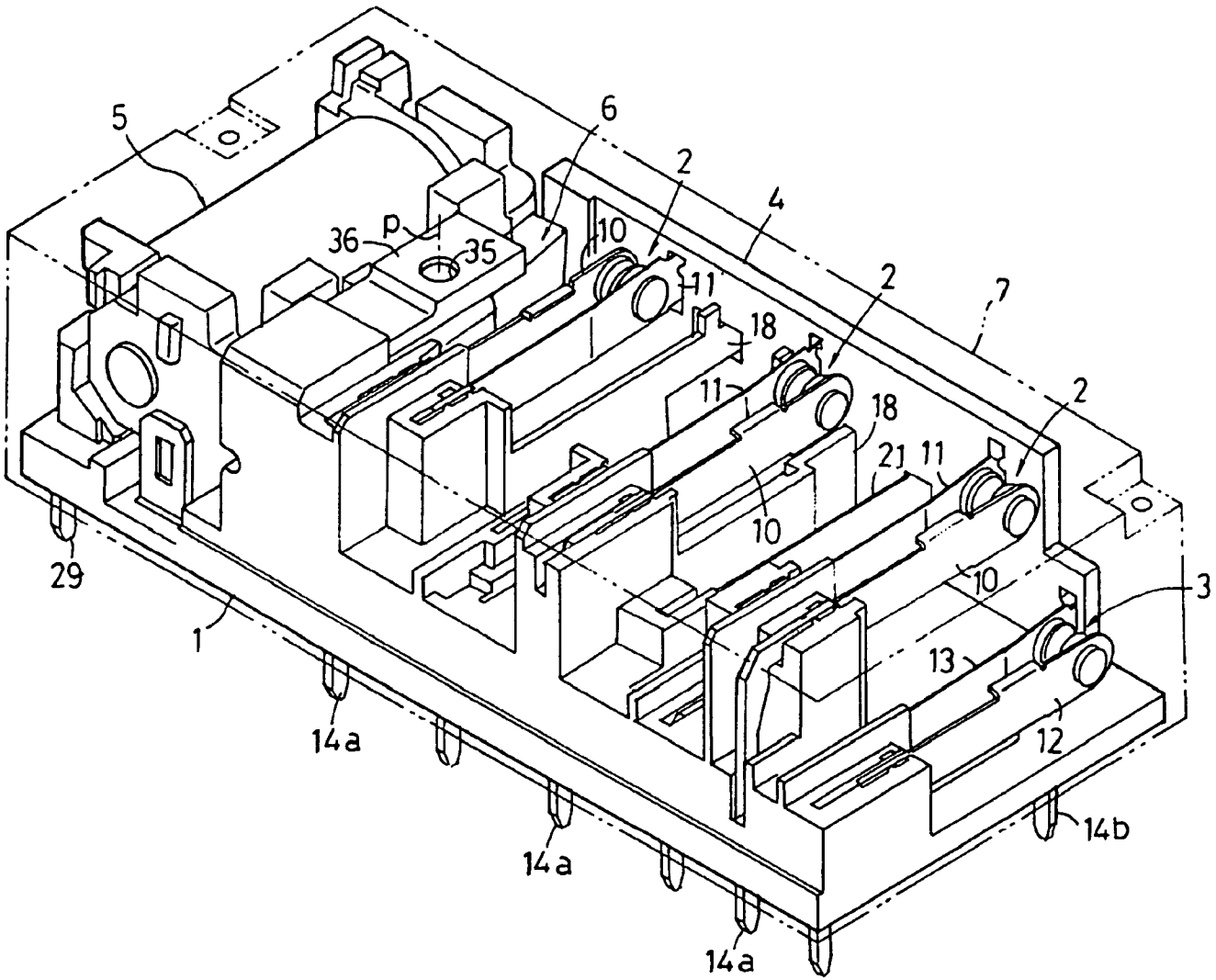
FIG. 2 shows a perspective view of the whole of the electromagnetic relay with the enclosure detached.
Figure 3:
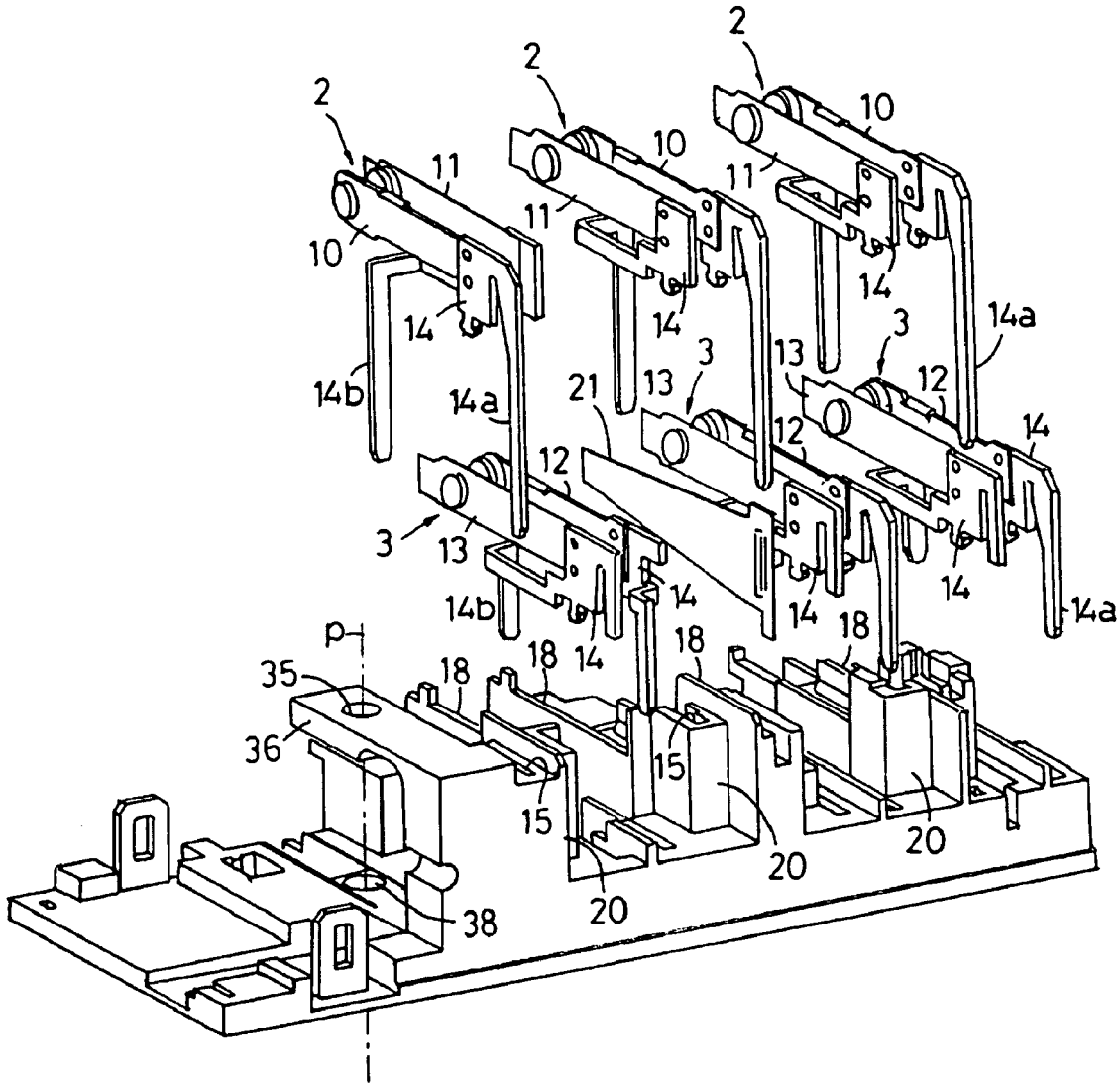
FIG. 3 shows a perspective view in which a base and a contact mechanism are taken apart.

FIG. 1 shows a transverse plan view of an electromagnetic relay according to the invention, FIG. 2 shows a perspective view of an internal structure of the electromagnetic relay, and FIG. 3 shows a perspective view in which a base and a contact mechanism are taken apart.

The electromagnetic relay mainly includes a base 1, multipolar contact mechanisms 2 and 3, a card 4, an electromagnetic block 5, a card driving movable block 6, and an enclosure 7. The base 1 is molded by a resin material. The base 1 is long in a lateral direction and narrow in a cross direction. The contact mechanisms 2 and 3 are assembled to the base 1 in upper and lower stages. The card 4 is a contact switching moving body which is guided and supported on a rear side of the base 1 (upper side in FIG. 1) while being linearly reciprocally movable in the lateral direction. The electromagnetic block 5 is fixed to a side-end portion (left-end portion in FIG. 1) of the base 1. The movable block 6 is arranged so as to face the electromagnetic block 5, and the movable block 6 is rotatably supported about a fulcrum p which is vertically provided with respect to the base 1. The enclosure 7 is fitted over the base 1 from above the base 1. Detailed structures of the components will be described below. In the following description, the upper side in FIG. 1 is referred to as rear side, and the lower side is referred to as front side. As seen in FIG. 1, the movable block 6 has an extension piece 6*a* that extends out perpendicularly from a main portion of the movable block 6 and that fits within an opening of the contact switch moving body 4.

In the embodiment, the electromagnetic block 5 and the movable block 6 are arranged in an inclination attitude with respect to the base 1 such that a virtual axis line of a rotating shaft about the fulcrum p of the movable block 6 extends in the vertical direction with respect to a bottom surface of the base 1 as shown in FIG. 3. Contact pieces 10, 11, 12, and 13 constituting the contact mechanisms 2 and 3 are also arranged in the inclination attitude with respect to the base 1 such that a longitudinal directions of the contact pieces 10, 11, 12, and 13 (vertical direction in FIG. 1) are parallel to the bottom surface of the base 1.

The contact mechanisms 2 and 3 are arranged in parallel along the lateral direction (moving direction of card 4), and the contact mechanisms 2 and 3 are alternately arranged along the lateral direction so as to be separated in the upper and lower stages.

That is, in the upper stage, the three-pole contact mechanisms 2 are laterally arranged in parallel. In the contact mechanism 2, the fixed contact piece 10 made of a thick plate material and the movable contact piece 11 made of a spring plate material are arranged in the lateral direction so as to face each other. In the embodiment, the left-end contact mechanism 2 constitutes a set of normally closed circuits, and the central and right-end contact mechanisms 2 constitute two sets of normally opened circuits. In the lower stage, the three-pole contact mechanisms 3 are laterally arranged in parallel. In the contact mechanism 3, the fixed contact piece 12 and the movable contact piece 13 are arranged in the lateral direction so as to face each other. In the embodiment, the contact mechanisms 2 constitute three sets of normally closed circuits.

As shown in FIG. 3, in the fixed contact pieces 10 and 12 and the movable contact pieces 11 and 13 of the upper and lower contact mechanisms 2 and 3, each of front-side base-end portions are fixed in a caulking manner to a support plate 14 made of the thick plate material. The contact pieces 10,11, 12, and 13 are cantilevered toward the rear side. Each support plate 14 is press-fitted downward into an attachment groove 15 formed in the base 1. Terminals 14*a* and 14*b* extending from the support plate 14 are projected in two rows back and forth from a lower surface of the base 1 while piercing through the base 1.

Figure 6:
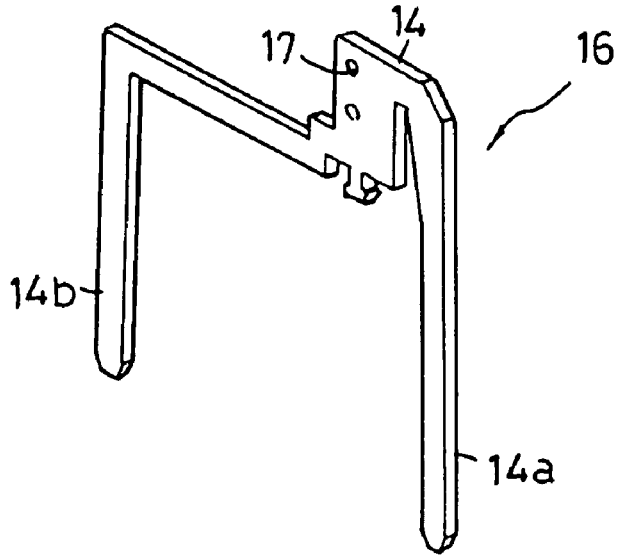
FIG. 6 shows a perspective view of a support plate material.
Figure 7:
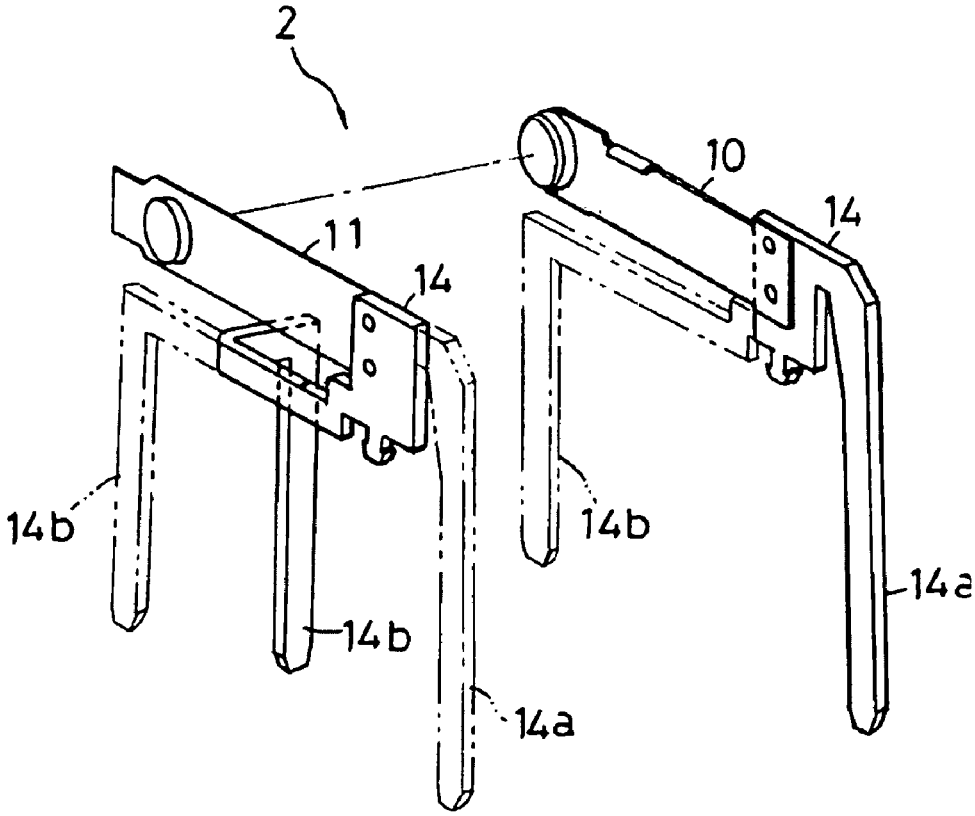
FIG. 7 shows a perspective view of an upper contact mechanism.
Figure 8:
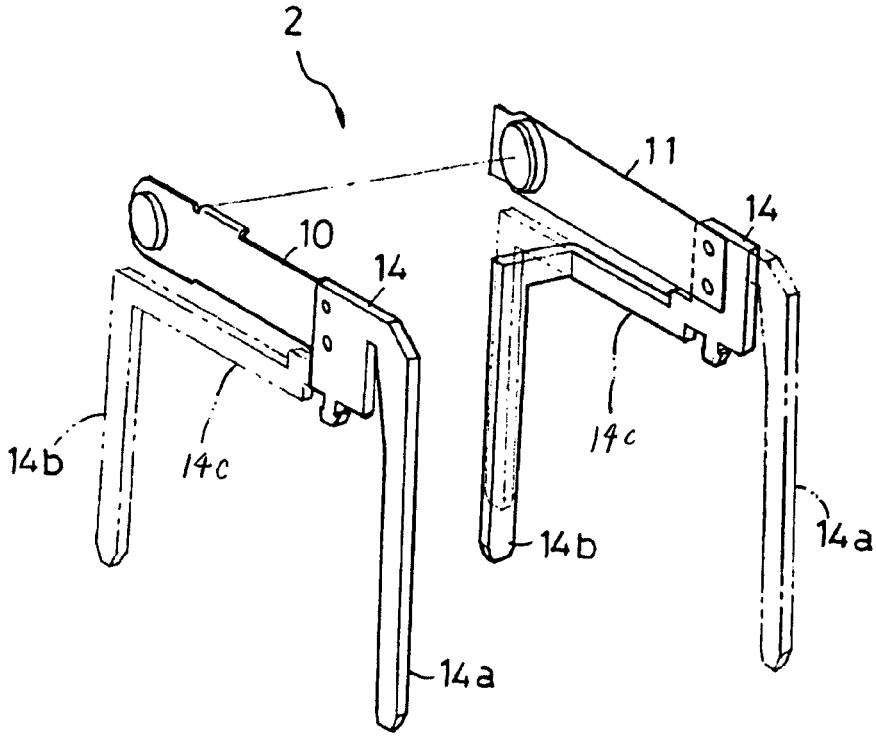
FIG. 8 shows a perspective view of another upper contact mechanism.

The support plate 14 of each of the contact mechanisms 2 and 3 is formed by cutting a part of a common support plate material 16 shown in FIG. 6. That is, the support plate material 16 is punched in a shape which includes a pair of long terminals 14*a* and 14*b*and a contact piece supporting caulking hole 17. The terminals 14*a* and 14*b* are located on the front and rear sides (corresponding to first and second extension parts) respectively. As shown in FIGS. 7 and 8, the support plate 14 of the fixed contact piece 10 in the upper contact mechanism 2 is provided on a coupling element 14*c* and is formed in the shape in which the rear-side terminal 14*b* is cut, and the support plate 14 of the movable contact piece 11 in the upper contact mechanism 2 is formed in the shape in which the rear-side terminal 14*b* is laterally bent while the front-side terminal 14*a* is cut.

Figure 9:
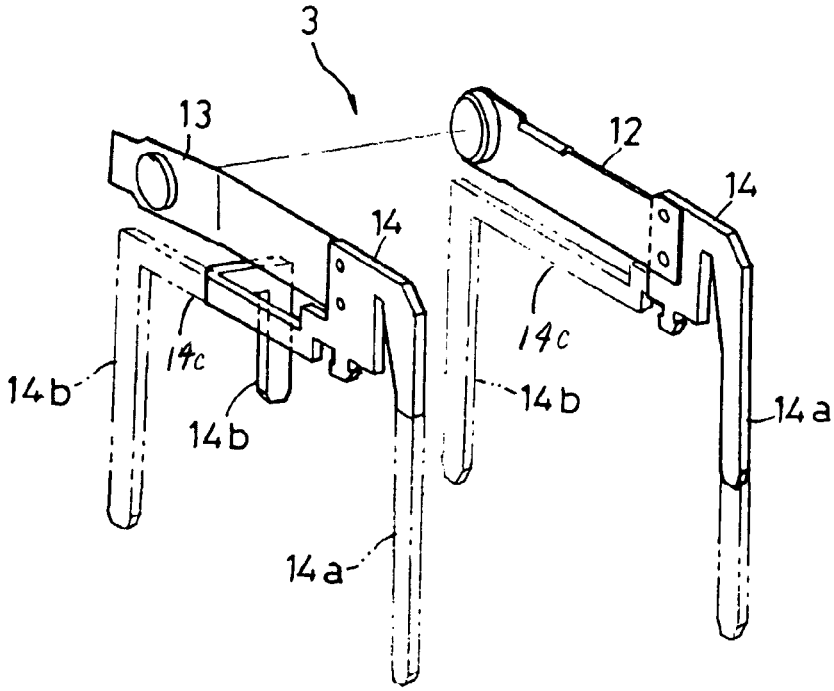
FIG. 9 shows a perspective view of the upper and lower contact mechanisms.

As shown in FIG. 9, the support plate 14 of the fixed contact piece 12 in the lower contact mechanism 3 is formed in the shape in which the front-side terminal 14 is shortly cut while the rear-side terminal 14*b* is cut, and the support plate 14 of the movable contact piece 13 in the lower contact mechanism 3 is formed in the shape in which the rear-side terminal 14*b* is laterally bent and shortly cut while the front-side terminal 14*a* is cut.

The upper contact mechanism 2 and the lower contact mechanism 3 are laterally arranged such that the positions of the mechanisms 2 and 3 are alternately shifted. Therefore, the insulation is satisfied between the adjacent contact mechanisms 2 and 3 while the downsizing of the electromagnetic relay is achieved in the lateral direction, and the contact mechanisms 2 and 3 can be assembled to the base 1 from above without obstructing each other.

Figure 5:
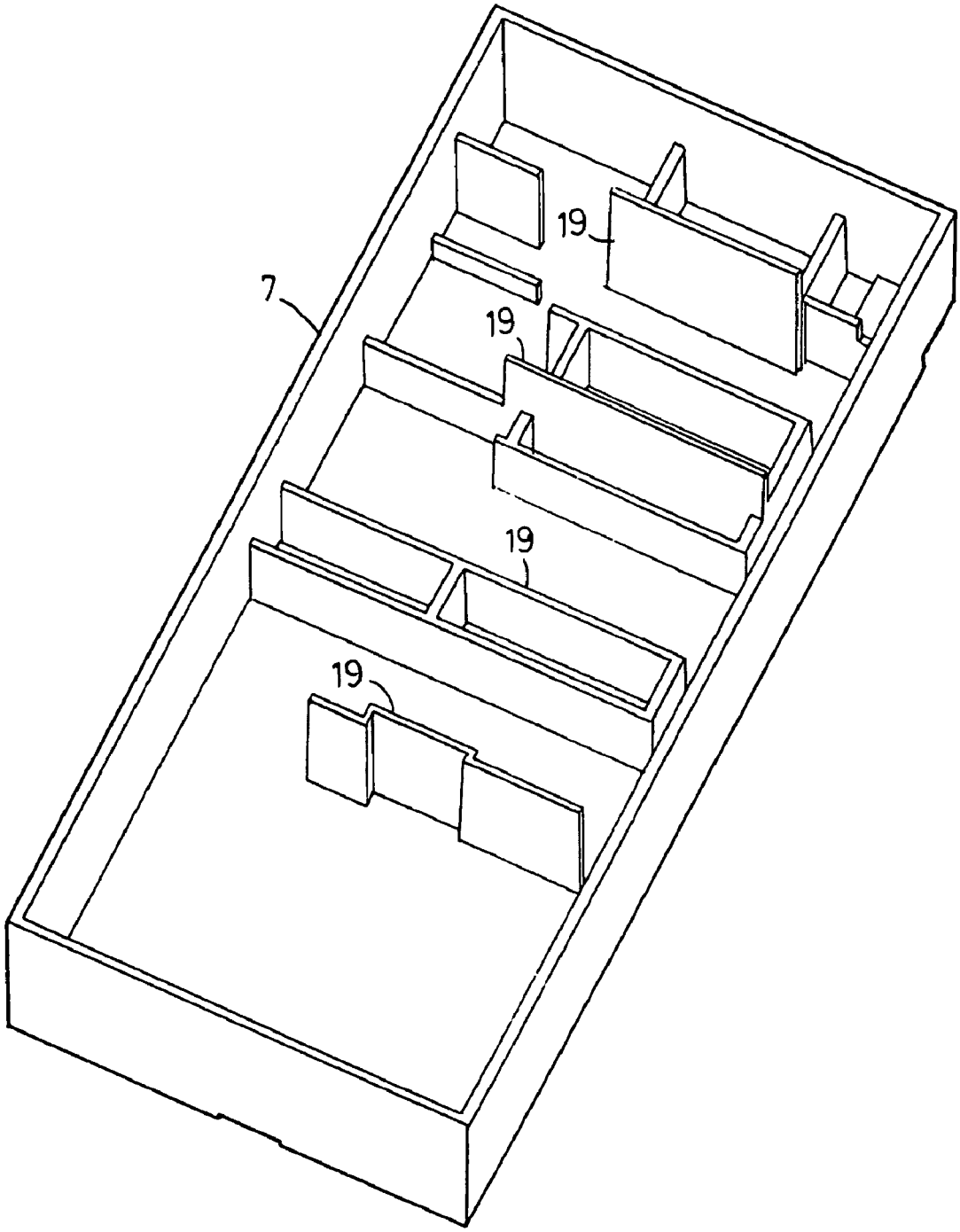
FIG. 5 shows a perspective view when the enclosure is viewed from inside.
Figure 10:
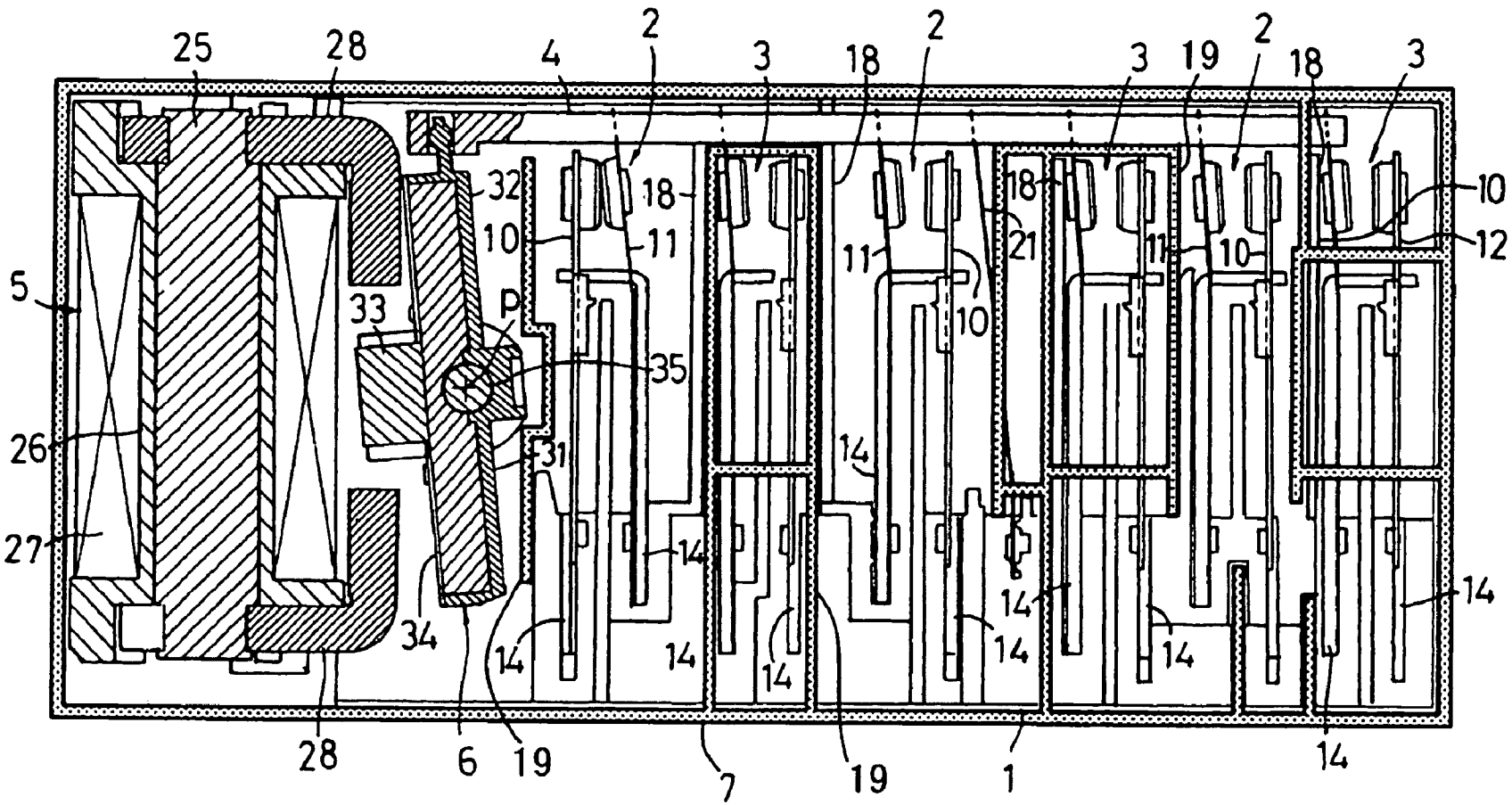
FIG. 10 shows a transverse sectional view of the electromagnetic relay with the enclosure attached.

As shown in FIGS. 1 to 3, partitions 18 are vertically provided at appropriate positions of the base 1 to establish the insulation between the contact mechanisms 2 and 3. As shown in FIG. 5, partitions 19 are also provided at appropriate positions in the enclosure 7 formed by resin molding. As shown in FIG. 10 which is a transverse sectional view of the electromagnetic relay with the enclosure 7 attached, the adjacent contact mechanisms 2 and 3 are partitioned by the partitions 18 and 19 to enhance the insulating properties.

The attachment groove 15 of the support plate 14 in the upper contact mechanism 2 is formed in a longitudinal wall portion 20 vertically provided from the base 1. The longitudinal wall portion 20 and the partition 18 are continuously provided to strengthen each other.

The card 4 is supported in the rear-side end portion of the partition 18 while being linearly slidable in the lateral direction. Idle ends of the movable contact pieces 11 and 13 are latched and supported in the contact mechanisms 2 and 3 respectively. The movable contact pieces 11 and 13 are laterally displaced to switch the contacts by the laterally reciprocal movement of the card 4. An idle end of a return spring 21 is latched in the card 4, and the return spring 21 is press-fitted in the base 1 while cantilevered toward the rear side. Return force toward the direction (leftward in FIG. 1) in which the electromagnetic block 5 is always imparted to the card 4 by elastic force of the return spring 21.

As shown in FIG. 1, in the electromagnetic block 5, a coil 27 is wound around a resin bobbin 26 fitted over an iron core 25, and magnetic-pole yokes 28 are coupled to both ends of the iron core 25 by the caulking. The movable block 6 is arranged so as to face a bent end portion of each yoke 28.

A pair of terminals 29 connected to the coil 27 is projected from the lower surface of the base 1. In non-magnetic excitation during which a current through the coil 27 is not passed, as shown in FIG. 1, the upper portion of the movable block 6 is rotated counterclockwise. In the magnetic excitation during which the current through the coil 27 is passed, the upper portion of the movable block 6 is rotated clockwise, which slidably moves the card 4 rightward in FIG. 1 to switch the upper and lower contact mechanisms 2 and 3.

As shown in FIG. 1, the movable block 6 includes a block main body 31, an iron piece 32, a rectangular block-shape permanent magnet 33, magnetic shielding plates 34, and a metal fulcrum shaft 35. The block main body 31 is molded by a resin material. The iron piece 32 formed by a thick iron plate is fitted over the front surface of the block main body 31. The permanent magnet 33 is attracted and fixed to the center of the front surface of the iron piece 32. The magnetic shielding plates 34 are attached to the upper and lower portion of the front surface of the iron piece 32, and the magnetic shielding plate 34 is made of a non-magnetic metal. The metal fulcrum shaft 35 is vertically inserted into the block main body 31. The both ends projected from the upper and lower surface of the movable block 6 are rotatably fitted in and supported by a bearing hole 37 and a bearing hole 38 respectively. The bearing hole 37 penetrates through a bearing portion 36 extending in the upper portion of the base 1, and the bearing hole 38 penetrates the bottom portion of the base 1.

Figure 4:
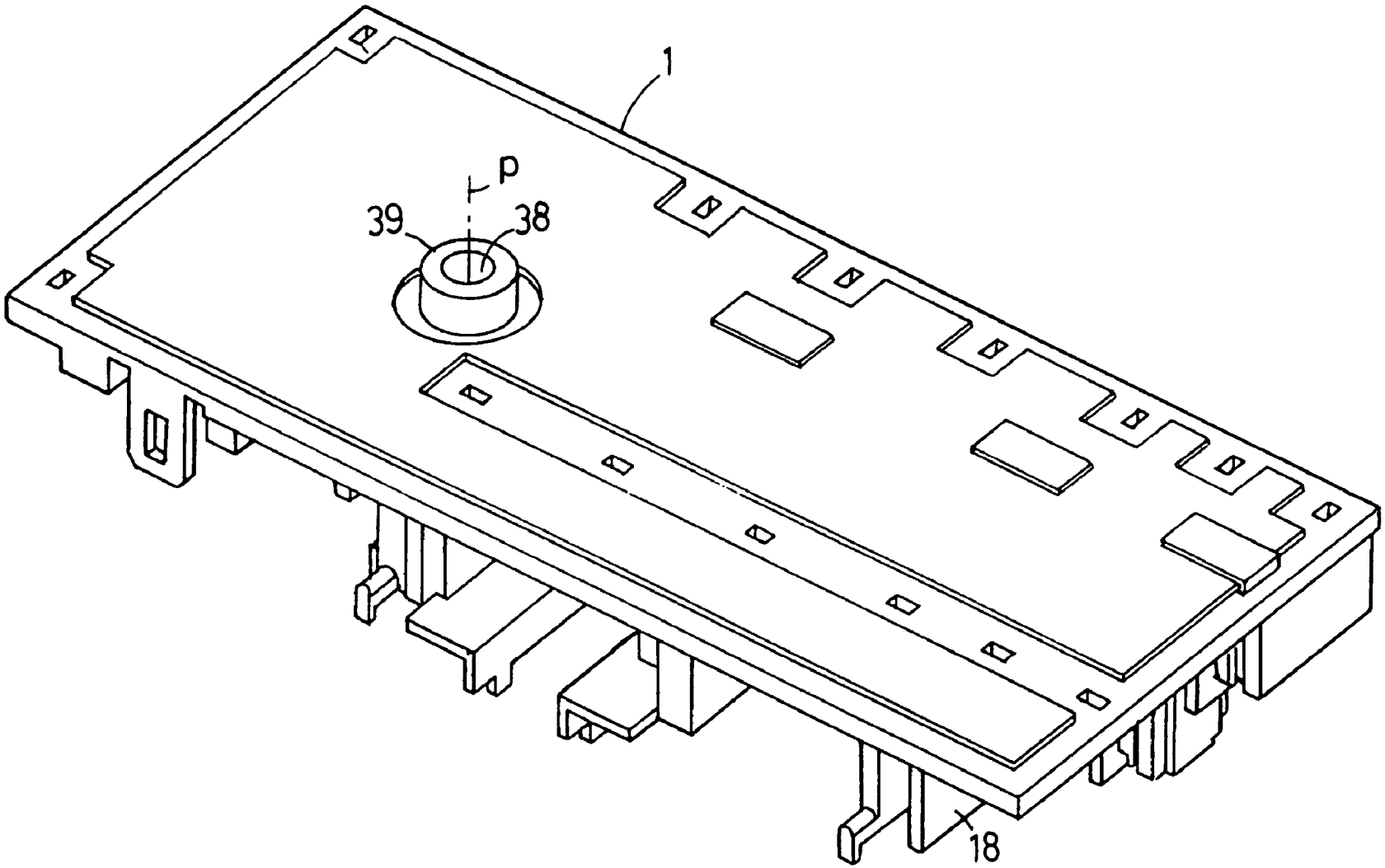
FIG. 4 shows a perspective view when the base is viewed from a bottom surface.

As shown in FIG. 4, a boss portion 39 surrounding the bearing hole 38 is projected from the bottom surface of the base. After the internal components are assembled, the boss portion 39 is heated and melted to seal the bearing hole 38, which prevents dust and moisture from intruding into the inside through the bearing portion 36.

Another Embodiment (1) In the above embodiment, the upper contact mechanism 2 and the lower contact mechanism 3 are alternately arranged such that not vertically overlapping each other. Alternatively, the upper contact mechanism 2 and the lower contact mechanism 3 can be arranged such that partially overlapping each other. In this case, the upper contact mechanism 2 is assembled after the lower contact mechanism 3 is assembled. In this structure, in order to secure the insulating properties between the upper mechanisms 2 and the lower contact mechanism 3, another insulating plate may be located between the upper contact mechanism 2 and the lower contact mechanism 3.

(2) The bearing hole 38 on the bottom side of the base 1 can be made in a bore hole which is not opened in the bottom surface. In this case, the thermal sealing boss portion 39 is not required.

What is claimed is:

1. An electromagnetic relay in which an electromagnetic block having an iron core around which a coil is wound; a movable block having an iron piece which is attracted to and separated from a magnetic pole portion of the electromagnetic block, the movable block being normally and reversely rotated by magnetic excitation and demagnetization of the electromagnetic block; a moving body engaging the movable block to be reciprocally moved in a linear direction according to the normal and reverse rotations; and a plurality of contact mechanisms in which switching is operated by the movement of the moving body are assembled to a base, wherein the electromagnetic block and the movable block are arranged such that a rotating shaft of the movable block is vertically located with respect to a bottom surface of the base, a fixed contact piece and a movable contact piece in the plurality of contact mechanisms are arranged such that longitudinal directions of the fixed contact piece and the movable contact piece are parallel to the bottom surface of the base, the plurality of contact mechanisms are arranged in parallel with the moving direction of the moving body in which respective pairs of the plurality of contact mechanisms are alternately arranged in upper and lower stages along the moving direction of the moving body without any straddling between any two of the contact mechanisms making up one of the pairs of the contact mechanisms arranged on the upper stage and any two of the contact mechanisms making up one of the pairs of the contact mechanism arranged on the lower stage, a terminal connected to the fixed contact piece and a terminal connected to the movable contact piece are projected downward from the bottom surface of the base, and an idle end portion of the movable contact piece is latched in the moving body.

2. An electromagnetic relay according to claim 1, wherein base ends of the fixed contact piece and movable contact piece constituting the contact mechanism are coupled to and supported by a support plate to which the terminal is continuously provided, and an attachment groove into which the support plate is press-fitted is formed in the base.

3. An electromagnetic relay according to claim 2, wherein a partition located between the contact mechanisms is vertically provided in the base, the contact mechanisms being arranged in parallel to the moving direction.

4. An electromagnetic relay according to claim 3, wherein the attachment groove is formed in a wall portion vertically provided in the base, the support plate of the contact mechanism arranged in the upper stage being press-fined into the attachment groove, and the wall portion is continuously provided to the partition.

5. An electromagnetic relay according to claim 4, wherein the partition located between the contact mechanisms is inside an enclosure fitted over the base, the contact mechanisms being arranged in parallel to the moving direction.

6. An electromagnetic relay according to claim 2, wherein the support plate is formed in a shape in which a part of a support plate material is cut to form a tongue, the tongue of the support plate material being sized so as to snugly fit into the attachment groove.

7. An electromagnetic relay according to claim 2, wherein a bearing hole is provided in a bottom portion of the base in which the bearing hole vertically penetrates through the bottom portion, the rotating shaft of the movable block being fitted in the bearing hole and supported by the bearing hole, and a boss portion is projected from the bottom surface of the base, the boss portion being positioned so as to seal an opening end of the bearing hole.

8. An electromagnetic relay according to claim 1, wherein the movable block includes an extension piece that extends out perpendicularly from a main portion of the movable block and that fits within an opening of the moving body that is provided on a distal end of the moving body disposed closest to the electromagnetic block, and wherein coupling of the extension piece of the movable block into the opening of the moving body causes movement of the moving body when the movable block rotates.

9. An electromagnetic relay according to claim 1, wherein the terminal comprises:

a first extension part extending downward from a respective one of the plurality of contact mechanisms to the base;

a second extension part extending downward from the respective one of the plurality of contact mechanisms to the base; and a coupling element that is disposed substantially perpendicular to the first and second extension parts, the coupling element being directly coupled to the respective one of the plurality of contact mechanisms.

* * * * *